US008763284B1

(12) United States Patent
Falcone et al.

(10) Patent No.: US 8,763,284 B1
(45) Date of Patent: Jul. 1, 2014

(54) GARMENT IRONING ASSEMBLY

(76) Inventors: James B. Falcone, Manalapan, NJ (US); Colette E. Falcone, Manalapan, NJ (US)

( * ) Notice: Subject to any disclaimer, the term of this patent is extended or adjusted under 35 U.S.C. 154(b) by 0 days.

(21) Appl. No.: 13/495,225

(22) Filed: Jun. 13, 2012

(51) Int. Cl.
*D06F 81/12* (2006.01)
*A47B 1/04* (2006.01)

(52) U.S. Cl.
USPC ..... 38/139; 108/99

(58) Field of Classification Search
USPC ..... 38/103, 104, 135–139; 108/6, 64, 65, 108/99, 166, 77, 80, 69, 134
See application file for complete search history.

(56) References Cited

U.S. PATENT DOCUMENTS

| | | | | | |
|---|---|---|---|---|---|
| 202,294 | A * | 4/1878 | Steves | 108/26 |
| 476,332 | A * | 6/1892 | Tubbs | 108/94 |
| 864,617 | A * | 8/1907 | Culbertson | 108/63 |
| 900,459 | A * | 10/1908 | Wise | 108/79 |
| 922,446 | A | 5/1909 | Barber | |
| 1,126,611 | A * | 1/1915 | Wright | 108/67 |
| 1,859,719 | A * | 5/1932 | Schrage | 108/69 |
| 2,803,897 | A | 8/1957 | Miyamoto | |
| 2,999,325 | A * | 9/1961 | Munson et al. | 38/140 |
| 3,188,985 | A * | 6/1965 | Lucas | 108/77 |
| 3,430,587 | A * | 3/1969 | Bender et al. | 108/78 |
| 5,016,367 | A | 5/1991 | Breen et al. | |
| 5,188,034 | A * | 2/1993 | Iaccino et al. | 101/474 |
| 5,199,353 | A * | 4/1993 | Szyszko | 101/474 |
| 5,513,578 | A * | 5/1996 | Tordsen | 108/77 |
| 6,286,237 | B1 * | 9/2001 | Toutounchian | 38/107 |
| D485,403 | S | 1/2004 | Inder | |
| 7,096,613 | B1 | 8/2006 | Springer | |
| 7,243,447 | B1 | 7/2007 | Springer | |
| 8,042,462 | B2 * | 10/2011 | Kim | 101/41 |
| 8,250,789 | B1 * | 8/2012 | Oliver | 38/135 |
| 2001/0013306 | A1 * | 8/2001 | Itakura et al. | 108/77 |

* cited by examiner

*Primary Examiner* — Ismael Izaguirre

(57) ABSTRACT

A garment ironing assembly includes a panel that has a top side, a bottom side and a perimeter edge. The perimeter edge includes a front edge, a back edge, a first lateral edge and a second lateral edge. A pair of first extensions each is hingedly coupled to the bottom side. Each of the first extensions is selectively positionable and releasably retained in an extended position. One of the first extensions is extendable outwardly from the first lateral edge and one of the first extensions is extendable outwardly from the second lateral edge. Each of the first extensions is positioned adjacent to the front edge. Each of the first extensions is angled away from the front end when the first extensions are in the extended position. A support structure is attached to and extends downwardly from the bottom side of the panel to support the panel above a support surface.

5 Claims, 4 Drawing Sheets

GARMENT IRONING ASSEMBLY

BACKGROUND OF THE DISCLOSURE

Field of the Disclosure

The disclosure relates to garment ironing devices and more particularly pertains to a new garment ironing device for supporting a shirt to be ironed.

SUMMARY OF THE DISCLOSURE

An embodiment of the disclosure meets the needs presented above by generally comprising a panel that has a top side, a bottom side and a perimeter edge. The perimeter edge includes a front edge, a back edge, a first lateral edge and a second lateral edge. A pair of first extensions each is hingedly coupled to the bottom side. Each of the first extensions has a first end, a second end, a top surface and a bottom surface. Each of the first extensions is selectively positionable and releasably retained in an extended position so the top surface is co-planar with the top side. One of the first extensions is extendable outwardly from the first lateral edge and one of the first extensions is extendable outwardly from the second lateral edge. Each of the first extensions is positioned adjacent to the front edge. The first extensions are each angled away from the front end when the first extensions are in the extended position. A support structure is attached to and extends downwardly from the bottom side of the panel to support the panel above a support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
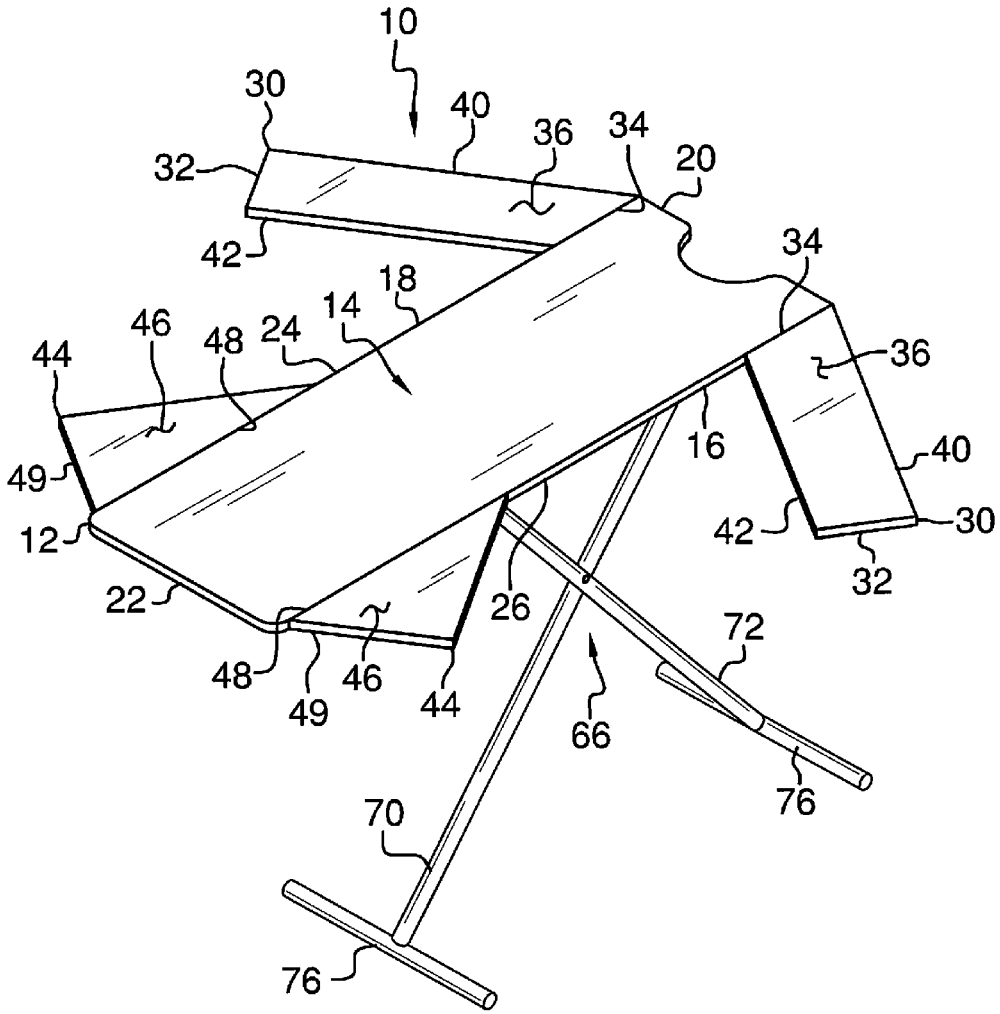
FIG. 1 is a top perspective view of a garment ironing assembly according to an embodiment of the disclosure.
Figure 2:
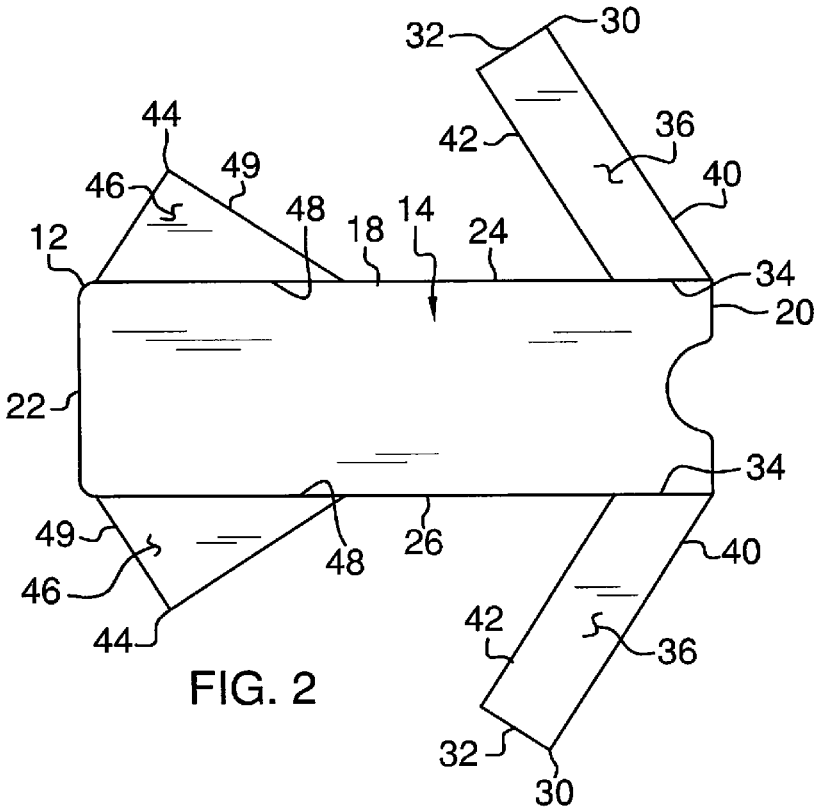
FIG. 2 is a top side view of an extended embodiment of the disclosure.
Figure 3:
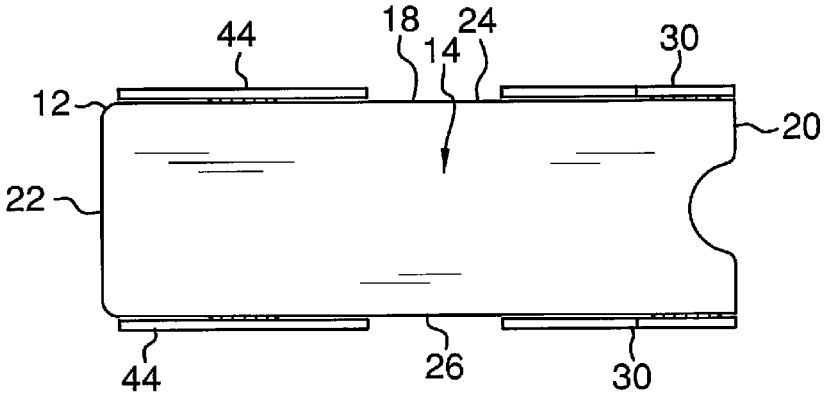
FIG. 3 is a top side view of a retracted embodiment of the disclosure.
Figure 4:
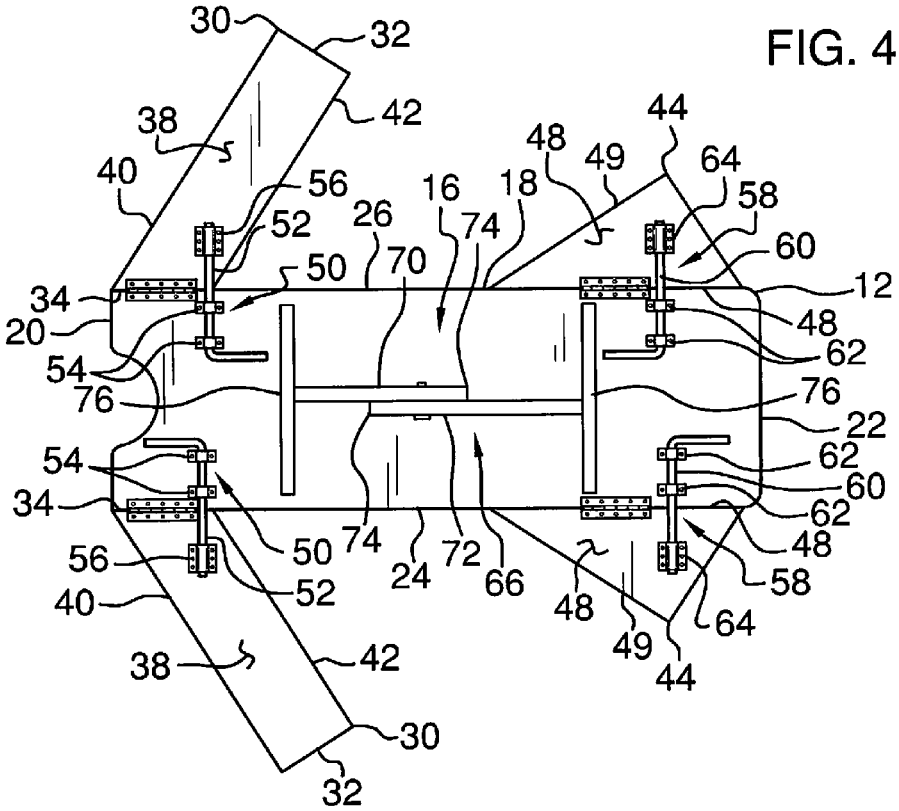
FIG. 4 is a bottom side view of an embodiment of the disclosure.
Figure 5:
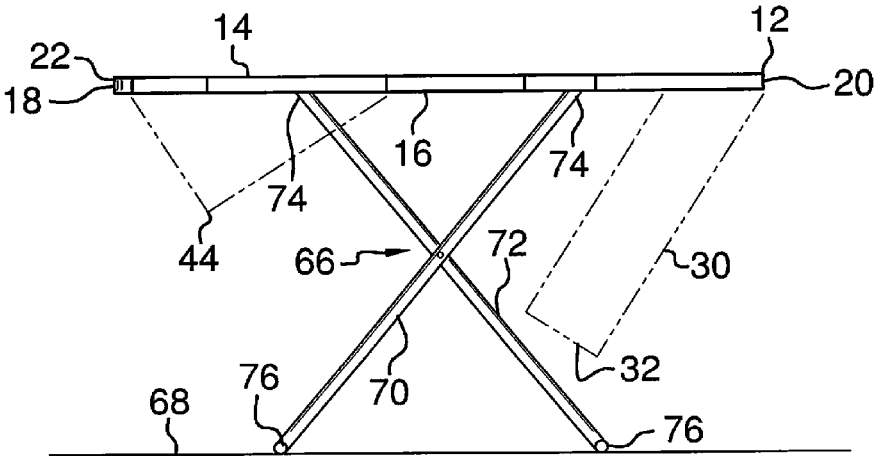
FIG. 5 is a side view of an embodiment of the disclosure.
Figure 6:
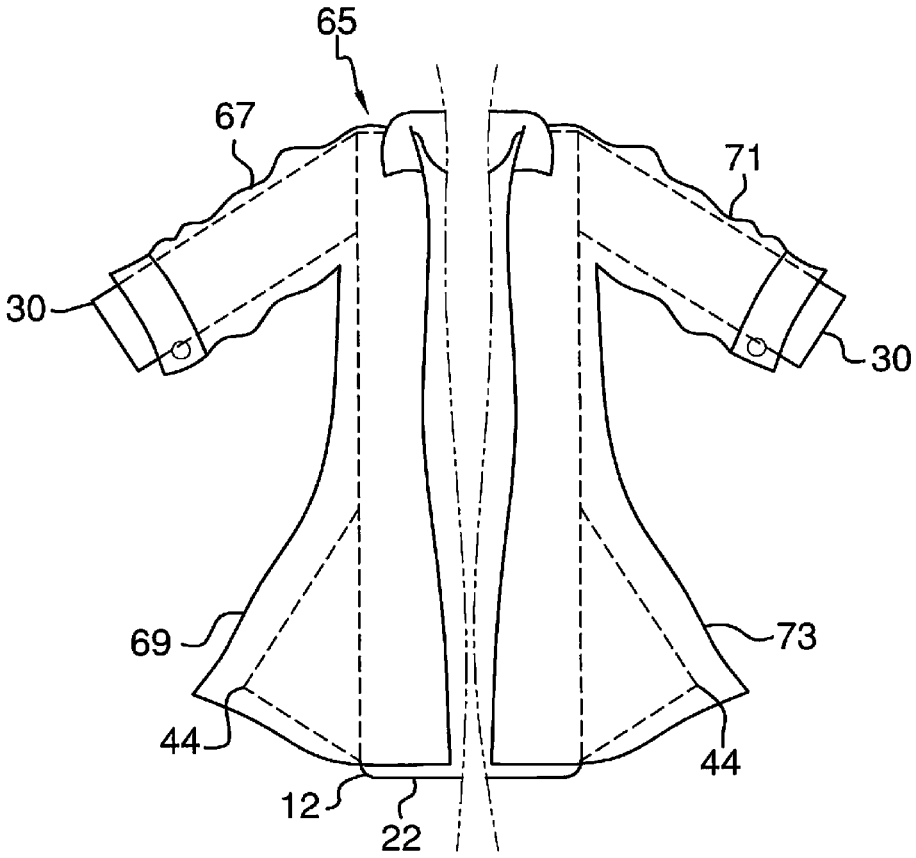
FIG. 6 is an in-use view of an embodiment of the disclosure.

With reference now to the drawings, and in particular to FIGS. 1 through 6 thereof, a new garment ironing device embodying the principles and concepts of an embodiment of the disclosure and generally designated by the reference numeral 10 will be described.

As best illustrated in FIGS. 1 through 6, the garment ironing assembly 10 generally comprises a panel 12 that has a top side 14, a bottom side 16 and a perimeter edge 18. The perimeter edge 18 includes a front edge 20, a back edge 22, a first lateral edge 24 and a second lateral edge 26. The front edge 20 is convexly arcuate and defines a semi-circular groove 28 extending toward the back edge 22. The panel 12 may be comprised of a rigid material.

A pair of first extensions 30 each is hingedly coupled to the bottom side 16. Each of the first extensions 30 has a first end 32, a second end 34, a top surface 36 and a bottom surface 38. The first extensions 30 each have a first side 40 and a second side 42 and each of the first 40 and second 42 sides is parallel to each other. The first ends 32 form a right angle with each of the first 40 and second 42 sides and the second ends 34 form an acute angle with each of the first sides 40. Each of the second ends 34 forms an obtuse angle with each of the second sides 42.

The first extensions 30 are each selectively positionable and releasably retained in an extended position so the top surface 36 is co-planar with the top side 14. One of the first extensions 30 is extendable outwardly from the first lateral edge 24 so the second end 34 abuts the first lateral edge 24. The other of the first extensions 30 is extendable outwardly from the second lateral edge 26 so the second end 34 abuts the second lateral edge 26. Each of the first extensions 30 is positioned adjacent to the front edge 20. Each of the first extensions 30 is angled away from the front edge 20 at an acute angle with the panel 12 when the first extensions 30 are in the extended position. Each of the first extensions 30 may have a width between 23 centimeters and 28 centimeters.

A pair of second extensions 44 each is hingedly coupled to the bottom side 16. Each of the second extensions 44 has an upper surface 46, a lower surface 48 and an exterior edge 49. The second extensions 44 are triangular shaped and each of the second extensions 44 is selectively positionable in and releasably retained in an extended position so the upper surface 46 is co-planar with the top side 14. The second extensions 44 may be comprised of a rigid material.

One of the second extensions 44 is extendable outwardly from the first lateral edge 24 so a base 48 of the triangular shape abuts the first lateral edge 24. The other one of the second extensions 44 is extendable outwardly from the second lateral edge 26 so the base 48 of the triangular shape abuts the second lateral edge 26. The second extensions 44 are each positioned adjacent to the rear edge 22. Each of the second extensions 44 is selectively positionable in a retracted position so each of the second extensions 44 extends downwardly from the bottom side 16.

A pair of first extension locks 50 is provided to retain each of the first extensions 30 in the extended position. One of the first extension locks 50 is attached to the bottom side 16 adjacent to the first lateral edge 24 and is positioned nearer to the front edge 20 than the back edge 22. The other of the first extension locks 50 is attached to the bottom side 16 adjacent to the second lateral edge 26 and positioned nearer to the front edge 20 than the back edge 22. The pair of first extension locks 50 each includes a first shaft 52 and a pair of first mounts 54. Each of the first shafts 52 is slidably retained in one of the pairs of the first mounts 54.

A pair of first receivers 56 each slidably receives one of the first shafts 52. One of the first receivers 56 is attached to the bottom surface 38 of one of the first extensions 30 adjacent to the second end 34. The other of the first receivers 56 is attached to the bottom surface 38 of the other first extension 30 adjacent to the second end 34. One of the first shafts 52 may be extended laterally away from the first lateral edge 24 to insertably engage one of the first receivers 56. The other of the first shafts 52 may be extended laterally away from the second lateral edge 26 to insertably engage the other of the first receivers 56.

A pair of second extension locks 58 is provided to retain each of the second extensions 44 in the extended position. One of the second extension locks 58 is attached to the bottom side 16 adjacent to the first lateral edge 24 and is positioned nearer to the back edge 22 than the front edge 20. The other of the second extension locks 58 is attached to the bottom side 16 adjacent to the second lateral edge 26 and is positioned nearer to the back edge 22 than the front edge 20. The pair of second extension locks 58 each includes a second shaft 60 and a pair of second mounts 62. Each of the second shafts 60 is slidably retained in one of the pairs of the second mounts 62.

A pair of second receivers 64 each slidably receives one of the second shafts 60. One of the second receivers 64 is attached to the lower surface 48 of one of the second extensions 44. The other of the second receivers 64 is attached to the lower surface 48 of the other second extension 44. One of the second shafts 60 may be extended laterally away from the first lateral edge 24 to insertably engage one of the second receivers 64. The other of the second shafts 60 may be extended laterally away from the second lateral edge 26 to insertably engage the other of the second receivers 64.

A support structure 66 is attached to and extends downwardly from the bottom side 16 to support the panel 12 above a support surface 68. The support structure 66 may comprise a first leg 70 and a second leg 72. The first 70 and second 72 legs may be rotatably attached to each other at an approximately central point. A top end 74 of the first 70 and second 72 legs may slidably engage the bottom side 16 and the support structure 66 may be collapsible so each of the first 70 and second legs 72 abuts the bottom side 16. The support structure 66 may be extendable so a base 76 of each of the first 70 and second 72 legs abuts the support surface 68.

A shirt 65 may be positioned on the assembly 10 and one of the first extensions 30 may be extended through a first sleeve 67 of the shirt 65 to be ironed. A first waist 69 of the shirt 65 may be laid out upon one of the second extensions 44 to iron the first waist 69. The first sleeve 67 and first waist 69 may be removed from the assembly 10 after ironing. The shirt 65 may be positioned on the assembly 10 and the other first extension 30 may be extended through a second sleeve 71 of the shirt 65 to be ironed. A second waist 73 of the shirt 65 may be laid out upon the other second extension 44 to iron the second waist 73.

In use, the various extensions of the assembly 10 are extended outwardly or collapsed as needed depending on the shape of a garment to be ironed. For example, a shirt 65 may be positioned on the assembly 10 to be ironed. One of the first extensions 30 may be extended through the first sleeve 67 of the shirt. The first waist 69 of the shirt may be laid out upon one of the second extensions 44. The other first extension 30 may be extended through the second sleeve 71 of the shirt 65. The second waist 73 of the shirt 65 may be laid out upon the other second extension 44. This allows for easy ironing of various sections of the shirt 65.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A garment ironing assembly configured for supporting a shirt to be ironed, said assembly comprising:

a panel having a top side, a bottom side and a perimeter edge, said perimeter edge including a front edge, a back edge, a first lateral edge and a second lateral edge;

a pair of first extensions each being hingedly coupled to said bottom side, each of said first extensions having a first end, a second end, a top surface and a bottom surface, each of said first extensions being selectively positionable and releasably retained in an extended position having said top surface lying being co-planar with said top side, one of said first extensions being extendable outwardly from said first lateral edge and one of said first extensions being extendable outwardly from said second lateral edge, each of said first extensions being positioned adjacent to said front edge, each of said first extensions being angled away from said front end when said first extensions are in said extended position, each of said first extensions being positionable in a non-extended position extending downwardly from said top side such that said top surfaces form a perpendicular angle with said first ends positioned vertically below said second ends;

a support structure being attached to and extending downwardly from said bottom side of said panel to support said panel above a support surface;

said front edge consisting of a pair of linear portions and a concavely arcuate portion, each of said first and second lateral edges abutting one of said linear portions, said concavely arcuate portion being positioned between said linear portions, said concavely arcuate portion defining a semi-circular groove extending toward said back edge.

2. The assembly according to claim 1, further including a pair of second extensions each being hingedly coupled to said bottom side, each of said second extensions having an upper surface, a lower surface and an exterior edge, each of said second extensions being triangular shaped, each of said second extensions being selectively positionable in and releasably retained in an extended position having said upper surface being co-planar with said top side, one of said second extensions being extendable outwardly from said first lateral edge and one of said second extensions being extendable outwardly from said second lateral edge, said second extensions each being positioned adjacent to said rear edge, each of said second extensions being selectively positionable in a retracted position having each of said second extensions extending downwardly from said bottom side.

3. A garment ironing assembly configured for supporting a shirt to be ironed, said assembly comprising:

a panel having a top side, a bottom side and a perimeter edge, said perimeter edge including a front edge, a back edge, a first lateral edge and a second lateral edge;

a pair of first extensions each being hingedly coupled to said bottom side, each of said first extensions having a first end, a second end, a top surface and a bottom surface, each of said first extensions being selectively positionable and releasably retained in an extended position having said top surface lying being co-planar with said top side, one of said first extensions being extendable outwardly from said first lateral edge and one of said first extensions being extendable outwardly from said second lateral edge, each of said first extensions being positioned adjacent to said front edge, each of said first extensions being angled away from said front end when said first extensions are in said extended position, each of said first extensions being positionable in a non-extended position extending downwardly from said top side such that said top surfaces form a perpendicular angle with said first ends positioned vertically below said second ends;

a pair of second extensions each being hingedly coupled to said bottom side, each of said second extensions having an upper surface, a lower surface and an exterior edge, each of said second extensions being triangular shaped, each of said second extensions being selectively positionable in and releasably retained in an extended position having said upper surface being co-planar with said top side, one of said second extensions being extendable outwardly from said first lateral edge and one of said second extensions being extendable outwardly from said second lateral edge, said second extensions each being positioned adjacent to said rear edge, each of said second extensions being selectively positionable in a retracted position having each of said second extensions extending downwardly from said bottom side; and a support structure being attached to and extending downwardly from said bottom side of said panel to support said panel above a support surface.

4. The assembly according to claim 3, wherein said front edge consists of a pair of linear portions and a concavely arcuate portion, each of said first and second lateral edges abutting one of said linear portions, said concavely arcuate portion being positioned between said linear portions, said concavely arcuate portion defining a semi-circular groove extending toward said back edge.

5. A garment ironing assembly configured for supporting a shirt to be ironed, said assembly comprising:

a panel having a top side, a bottom side and a perimeter edge, said perimeter edge including a front edge, a back edge, a first lateral edge and a second lateral edge;

a pair of first extensions each being hingedly coupled to said bottom side, each of said first extensions having a first end, a second end, a top surface and a bottom surface, each of said first extensions being selectively positionable and releasably retained in an extended position having said top surface lying being co-planar with said top side, one of said first extensions being extendable outwardly from said first lateral edge and one of said first extensions being extendable outwardly from said second lateral edge, each of said first extensions being positioned adjacent to said front edge, each of said first extensions being angled away from said front end when said first extensions are in said extended position, each of said first extensions being positionable in a non-extended position extending downwardly from said top side such that said top surfaces form a perpendicular angle with said first ends positioned vertically below said second ends;

a support structure being attached to and extending downwardly from said bottom side of said panel to support said panel above a support surface; and a pair of second extensions each being hingedly coupled to said bottom side, each of said second extensions having an upper surface, a lower surface and an exterior edge, each of said second extensions being triangular shaped, each of said second extensions being selectively positionable in and releasably retained in an extended position having said upper surface being co-planar with said top side, one of said second extensions being extendable outwardly from said first lateral edge and one of said second extensions being extendable outwardly from said second lateral edge, said second extensions each being positioned adjacent to said rear edge, each of said second extensions being selectively positionable in a retracted position having each of said second extensions extending downwardly from said bottom side.

* * * * *